US011812813B1

(12) United States Patent
Fogg

(10) Patent No.: US 11,812,813 B1
(45) Date of Patent: Nov. 14, 2023

(54) DEMI-HELMET AND MASK COMBINATION PROVIDING FACIAL IMPACT PROTECTION AND ENTIRELY UNOBSTRUCTED VIEWS IN BOTH FORWARD AND PERIPHERAL DIRECTIONS, AND ASSOCIATED METHODS

(71) Applicant: Michael L. Fogg, Atlantic Beach, FL (US)

(72) Inventor: Michael L. Fogg, Atlantic Beach, FL (US)

( * ) Notice: Subject to any disclaimer, the term of this patent is extended or adjusted under 35 U.S.C. 154(b) by 0 days.

(21) Appl. No.: 15/943,259

(22) Filed: Apr. 2, 2018

Related U.S. Application Data

(60) Division of application No. 15/388,182, filed on Dec. 22, 2016, now abandoned, which is a continuation-in-part of application No. 13/975,630, filed on Aug. 26, 2013, now abandoned.

(60) Provisional application No. 61/759,188, filed on Jan. 31, 2013.

(51) Int. Cl.
*A42B 3/20* (2006.01)
*A63B 71/10* (2006.01)
*A42B 3/12* (2006.01)

(52) U.S. Cl.
CPC ..... *A42B 3/20* (2013.01); *A42B 3/125* (2013.01); *A63B 71/10* (2013.01)

(58) Field of Classification Search
CPC .. A42B 3/00; A42B 3/125; A42B 3/20; A63B 71/10
USPC ..... 2/9, 410, 424, 425, 421
See application file for complete search history.

(56) References Cited

U.S. PATENT DOCUMENTS

| | | | | | |
|---|---|---|---|---|---|
| 200,358 | A | | 2/1878 | Thayer | |
| 376,278 | A | * | 1/1888 | Barnard | A42B 3/20 2/9 |
| 628,724 | A | * | 7/1899 | Rogers | A42B 3/20 2/9 |
| 2,929,070 | A | | 3/1960 | Novak | |
| 3,167,783 | A | | 2/1965 | Wolfe | |
| 3,407,809 | A | | 10/1968 | Ross | |
| 3,900,897 | A | | 8/1975 | Dunning | |
| 4,031,564 | A | | 6/1977 | Wood | |
| 4,233,687 | A | * | 11/1980 | Lancellotti | A42B 3/20 2/9 |
| 4,370,759 | A | * | 2/1983 | Zide | A63B 71/10 2/424 |
| 4,575,875 | A | * | 3/1986 | Dawson | A42B 3/227 2/10 |
| 4,933,993 | A | * | 6/1990 | McClelland | A42B 3/20 2/424 |
| 4,947,490 | A | | 8/1990 | Hayden | |
| 4,985,938 | A | * | 1/1991 | Snow, Jr. | A42B 3/20 2/424 |
| 5,384,914 | A | | 1/1995 | Caveness | |

(Continued)

*Primary Examiner* — Katharine G Kane
(74) *Attorney, Agent, or Firm* — Cynthia S. Lamon; Lamon Patent Services

(57) ABSTRACT

A demi-helmet and a detachable face mask combination protects the full face of the person wearing the demi-helmet, with the face mask comprising multiple-spaced impact-resistant bars forming a cage in front of the face of the wearer and with vertical struts between adjacent bars constructed and arranged to leave the view of the wearer entirely unobstructed in both the forward and peripheral directions.

17 Claims, 7 Drawing Sheets

(56) References Cited

U.S. PATENT DOCUMENTS 5,477,565 A * 12/1995 Hunt, Jr. ..... A42B 3/20 2/423
D366,539 S * 1/1996 Lackovic ..... D29/106
5,479,658 A 1/1996 Harris
5,502,843 A * 4/1996 Strickland ..... A44B 18/00 2/9
5,546,609 A * 8/1996 Rush, III ..... A41D 13/018 2/413
5,661,849 A 9/1997 Hicks
5,724,681 A * 3/1998 Sykes ..... A42B 3/003 2/411
5,806,088 A 9/1998 Zide
5,893,174 A * 4/1999 Primeau ..... A42B 3/20 2/10
5,953,761 A * 9/1999 Jurga ..... A42B 3/145 2/414
5,963,990 A 10/1999 White
6,047,400 A 4/2000 Spencer
6,189,156 B1 * 2/2001 Loiars ..... A42B 3/20 2/424
6,438,762 B1 * 8/2002 Jenkins ..... A42B 3/10 2/267
6,499,139 B1 12/2002 Brown et al.
6,708,339 B1 3/2004 Smith, Jr.
6,938,272 B1 * 9/2005 Brown ..... A42B 3/20 2/424
D517,250 S 3/2006 Polstein
7,434,268 B2 * 10/2008 Futch ..... A42B 3/08 2/424
7,649,700 B1 * 1/2010 Diemer ..... A42B 3/0406 2/10
7,900,279 B2 3/2011 Kraemer et al.
D651,355 S 12/2011 Schwabe et al.
8,209,784 B2 * 7/2012 Nimmons ..... A42B 3/20 2/411
8,719,967 B2 * 5/2014 Milsom ..... A42B 3/122 2/411
8,973,172 B2 3/2015 Daniel
9,027,163 B1 5/2015 Schmidt
9,277,781 B2 3/2016 Hardy
9,314,060 B2 4/2016 Giles
9,439,471 B2 9/2016 Wehtje
D773,742 S 12/2016 Williams
D786,508 S 5/2017 Ricket
9,675,128 B2 * 6/2017 Allen ..... A42B 3/20
2004/0025231 A1 * 2/2004 Ide ..... A42B 3/08 2/425
2004/0133968 A1 7/2004 Darnell
2005/0015855 A1 * 1/2005 Skiba ..... A42B 3/063 2/412
2007/0151003 A1 * 7/2007 Shih ..... A42B 3/20 2/424
2007/0250990 A1 * 11/2007 Brown ..... A42B 3/06 2/414
2007/0250992 A1 * 11/2007 Brown ..... A42B 3/20 2/424
2008/0092277 A1 * 4/2008 Kraemer ..... A42B 3/205 2/421
2008/0163410 A1 * 7/2008 Udelhofen ..... A42B 3/20 2/413
2008/0250550 A1 * 10/2008 Bologna ..... A42B 3/20 2/425
2009/0044316 A1 2/2009 Udelhofen
2009/0083900 A1 4/2009 Wallace
2009/0106882 A1 4/2009 Nimmons
2009/0126063 A1 * 5/2009 Brown ..... A42B 3/20 2/12
2009/0265841 A1 10/2009 Ferrara
2010/0122402 A1 * 5/2010 Tipp ..... A42B 3/22 2/422
2011/0078844 A1 * 4/2011 Daniel ..... A42B 3/166 2/411
2011/0138520 A1 * 6/2011 DeBoer ..... A42B 3/20 2/425
2011/0209272 A1 9/2011 Drake
2011/0214225 A1 9/2011 Norris
2011/0247181 A1 * 10/2011 Lin ..... A42B 3/04 24/455
2011/0252543 A1 * 10/2011 De Harde ..... A42B 3/20 2/411
2011/0271428 A1 * 11/2011 Withnall ..... A42B 3/20 2/422
2012/0124721 A1 * 5/2012 Hampton, II ..... A42B 3/08 2/425
2012/0151663 A1 6/2012 Rumbaugh
2012/0210498 A1 6/2012 Mack
2012/0297525 A1 11/2012 Bain
2013/0042396 A1 2/2013 Wehtje
2013/0074248 A1 3/2013 Evans
2013/0180034 A1 7/2013 Preisler
2013/0312165 A1 11/2013 Hardy
2013/0340147 A1 12/2013 Giles
2014/0020153 A1 1/2014 Romanski
2014/0115759 A1 * 5/2014 Tomlin ..... A63B 71/10 2/411
2014/0223643 A1 8/2014 Infusino
2014/0223646 A1 * 8/2014 Bologna ..... A42B 3/08 2/424
2014/0325727 A1 * 11/2014 Allen ..... A42B 3/20 2/9
2014/0352039 A1 12/2014 Abbey
2015/0033457 A1 2/2015 Tryner
2015/0135413 A1 5/2015 Mayerovitch
2015/0164173 A1 6/2015 West
2015/0201695 A1 * 7/2015 Shih ..... A63B 71/10 2/9
2015/0230533 A1 8/2015 Bancroft
2015/0272258 A1 10/2015 Preisler
2016/0029733 A1 2/2016 Kovarik
2017/0231313 A1 * 8/2017 Johnson ..... A42B 3/20 2/424

* cited by examiner

DEMI-HELMET AND MASK COMBINATION PROVIDING FACIAL IMPACT PROTECTION AND ENTIRELY UNOBSTRUCTED VIEWS IN BOTH FORWARD AND PERIPHERAL DIRECTIONS, AND ASSOCIATED METHODS

CROSS-REFERENCE TO RELATED APPLICATIONS

This application is division of U.S. Non-provisional patent application Ser. No. 15/388,182, filed Dec. 22, 2016, which is a continuation-in-part of U.S. Non-provisional patent application Ser. No. 13/975,630, filed Aug. 26, 2013, which claims the benefit of U.S. Provisional Patent Application Ser. No. 61/759,188, filed on Jan. 31, 2013, the contents of which applications are all incorporated by reference in their entirety herein.

BACKGROUND OF THE INVENTION

The present invention relates to constructions and methods for demi-helmet and face mask combinations designed for full face protection while providing unobstructed views in both forward and peripheral directions.

A number of prior art designs have been created for helmets having face masks. Of particular interest are helmets that are not full size, but are either one-half or three-quarter size. These sizes are particularly popular with motorcyclists because they are lighter, less restrictive, and provide better visibility than full size helmets. For purposes of this disclosure, the term "demi-helmet" is used to denote those helmets that are less than full size, such as the one-half or three-quarter size helmets.

SUMMARY OF THE INVENTION

The present invention discloses multiple embodiments of demi-helmet and face mask combinations designed to protect the full face of the person wearing the demi-helmet while permitting the person to have entirely unobstructed views in both forward and peripheral directions through and outwardly from the face mask. To this end, the unit comprises a demi-helmet having a top portion dimensioned to fit over the head of a wearer, a forward edge, a bottom edge and opposing side portions that extend downwardly from the top portion when the helmet has been donned by the wearer and is in use. The demi-helmet has internal padding for the comfort of the wearer. In accordance with this invention, a detachable face mask is provided that is designed to protect all of the wearer's face that is exposed forwardly and downwardly from the bottom edge of the demi-helmet. In preferred embodiments, the face mask comprises multiple spaced impact-resistant bars that form a cage in front of the face of the wearer in a manner that entirely avoids interfering with the wearer's views outwardly in both the forward and peripheral directions. A first one of the bars extends along and preferably is attached to the front edge of the demi-helmet. A second bar extends across the front opening of the demi-helmet and generally around the protected space where the face of the wearer will be located while the demi-helmet is in use. The first and second bars extend between the opposing side portions and are removably attached to the demi-helmet at opposing common points on the opposing side portions. First and second vertical struts are fitted between the first and second bars each at an opposing side portion to provide additional structural strength. Each of the first and second vertical struts are positioned vertically between the first and second bars and rearwardly toward the bottom edge so as to avoid obstructing the peripheral view of the wearer of the helmet. To achieve this, the rearward ends of the first and second bars and the corresponding first and second struts on both sides are formed in a concave shape to leave open and free of obstruction the peripheral view of the wearer. In the preferred embodiment, a third bar is utilized below the second bar and across and below the protected space, with third and fourth vertical struts between the second and third bars.

The demi-helmet and face mask constructions of this invention are not only useful for full face protection of motorcyclists, but are also useful in many other applications such as snow sports, skateboarding, bicycling and other activities.

DETAILED DESCRIPTION

Figure 1:
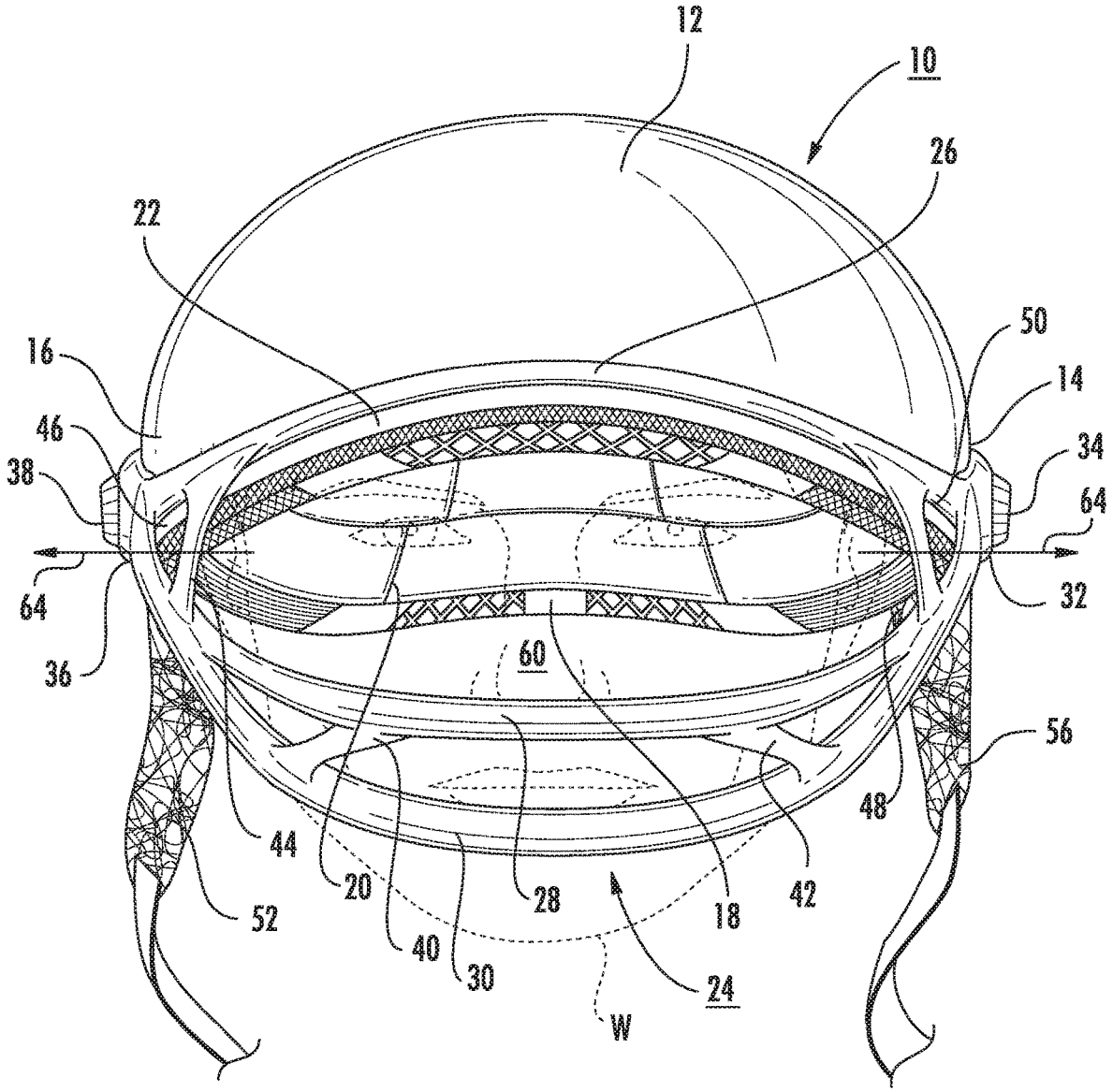
FIGS. 1-5 are, respectively, front, side, top, rear and bottom views of a first embodiment of a demi-helmet and face mask combination in accordance with the present invention. The head of the wearer is shown by dotted lines in FIG. 1, and by solid lines in FIG. 2.
Figure 2:
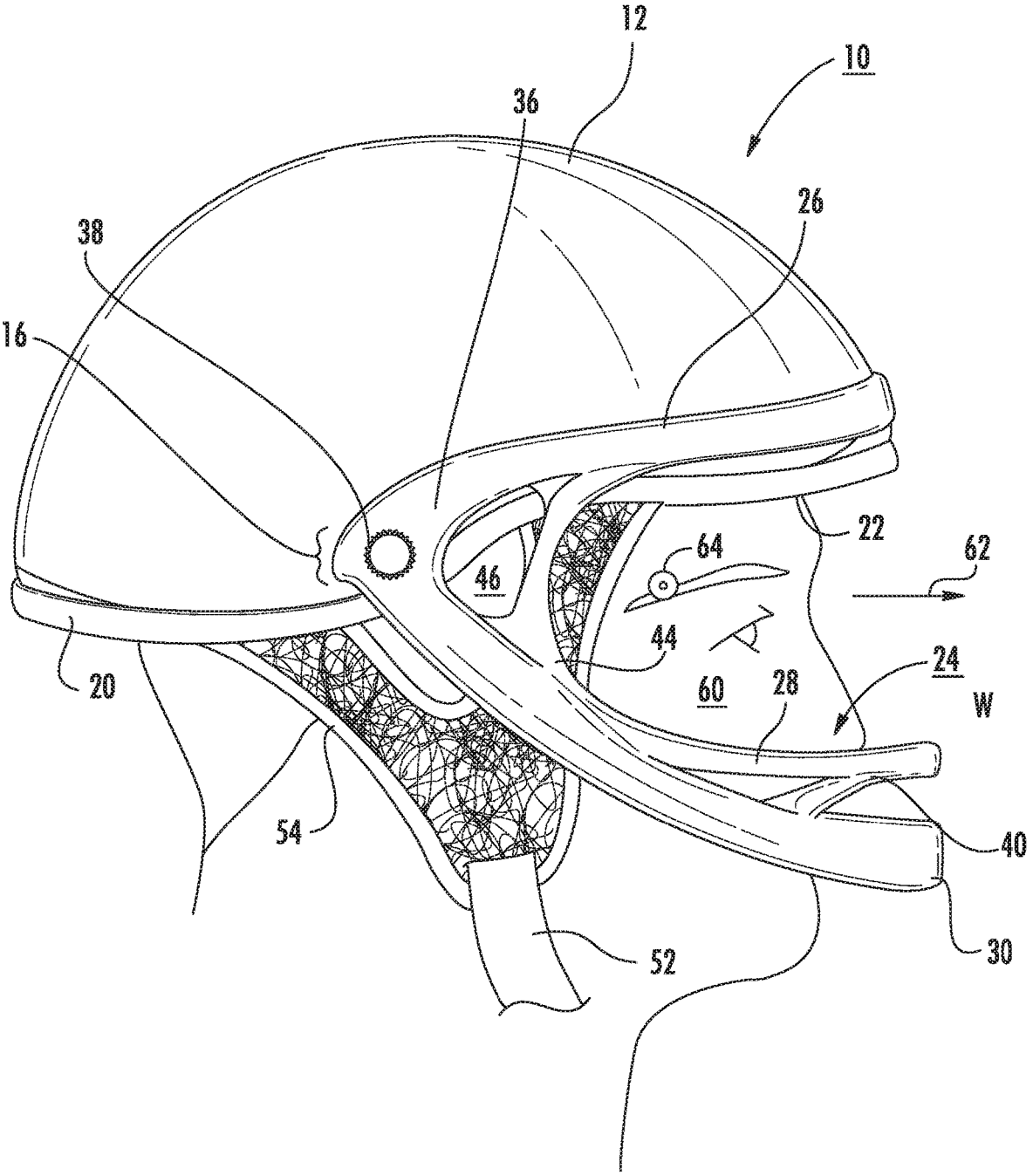
Figure 3:
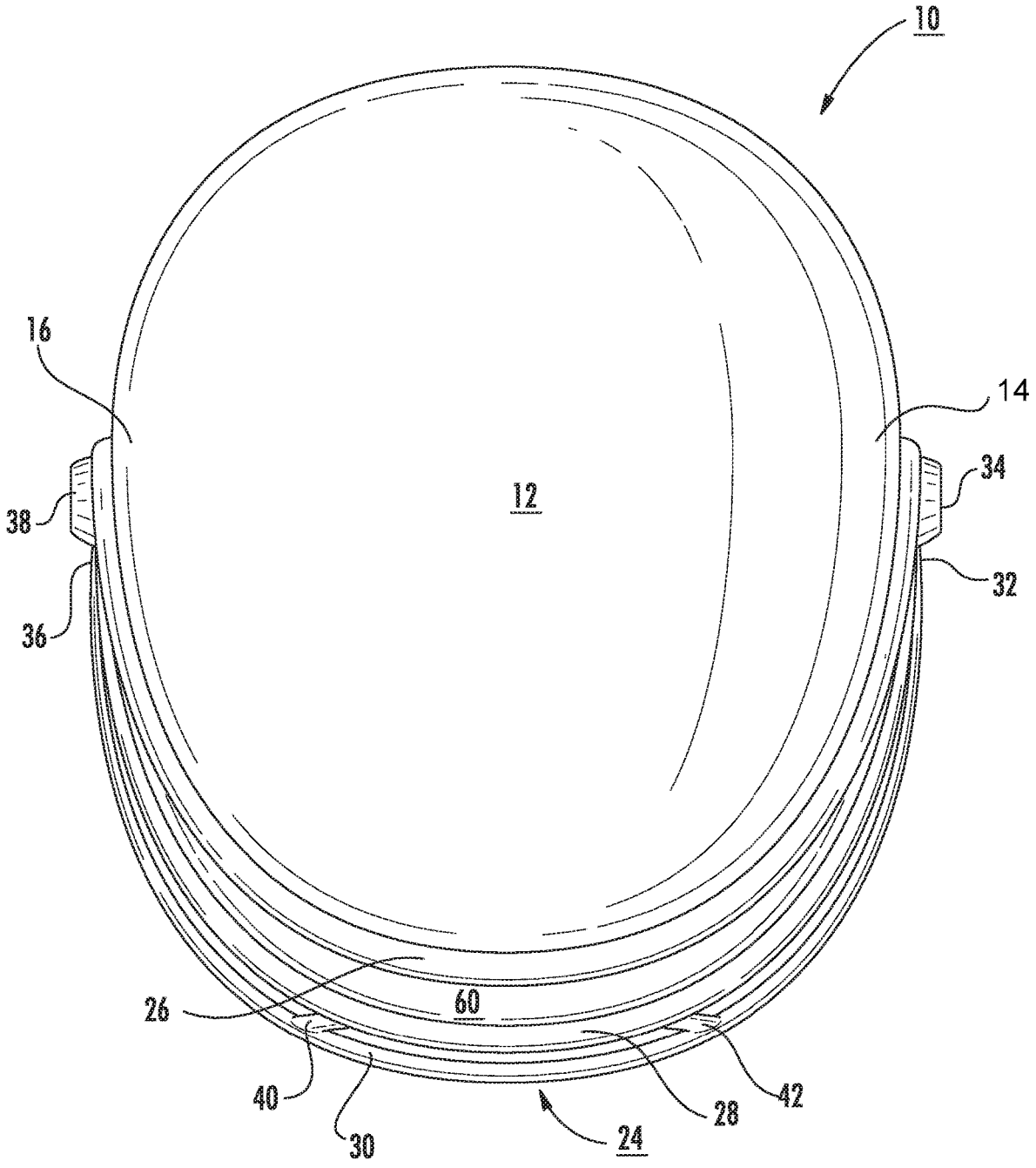

A preferred embodiment of the demi-helmet and face mask construction in accordance with the present invention will now be described with reference to FIGS. 1-5, where the combination is referred to generally with the reference numeral 10 and the face mask is specifically referred to with reference numeral 24. In FIGS. 1 and 2, the wearer of the helmet 10 is referred to by the letter W.

The demi-helmet portion of the construction 10 includes a top portion 12 dimensioned to fit over the head of the wearer when in use. The demi-helmet includes opposing side portions 14, 16 extending downwardly from the top portion 12, a rearward bottom edge 18 and a forward edge 22 across the upper border of a protected space 60, described below. A padded lining 20 extends across the inside of the demi-helmet and between the side portions 14, 16.

The face mask 24 of the construction 10 comprises first, second and third spaced impact-resistant bars 26, 28 and 30 with the second and third bars 28, 30 defining the protected space 60 in front of the person W wearing the construction 10. The first bar 26 extends between the opposing side portions 14, 16 and preferably across and attached to the front edge 22. The second and third bars 28, 30 are spaced apart from each other and extend outwardly from the opposing side portions 14, 16 and forwardly in front of and underneath the protected space 60. It will be appreciated that the second and third bars 28, 30 may be formed together as a single unit so long as the space 60 is fully protected.

The ends of the three bars 26, 28 and 30 converge together at the opposite side portions 14, 16 at respective areas 32, 36 and are fastened to the respective side portions 14, 16 with corresponding fasteners 34, 38. Preferably, the three bars 26, 28 and 30 and the areas 32, 36 are fabricated with a high impact-resistant core. A cast metal frame with a sintered powder or vinyl coat is suitable.

Figure 4:
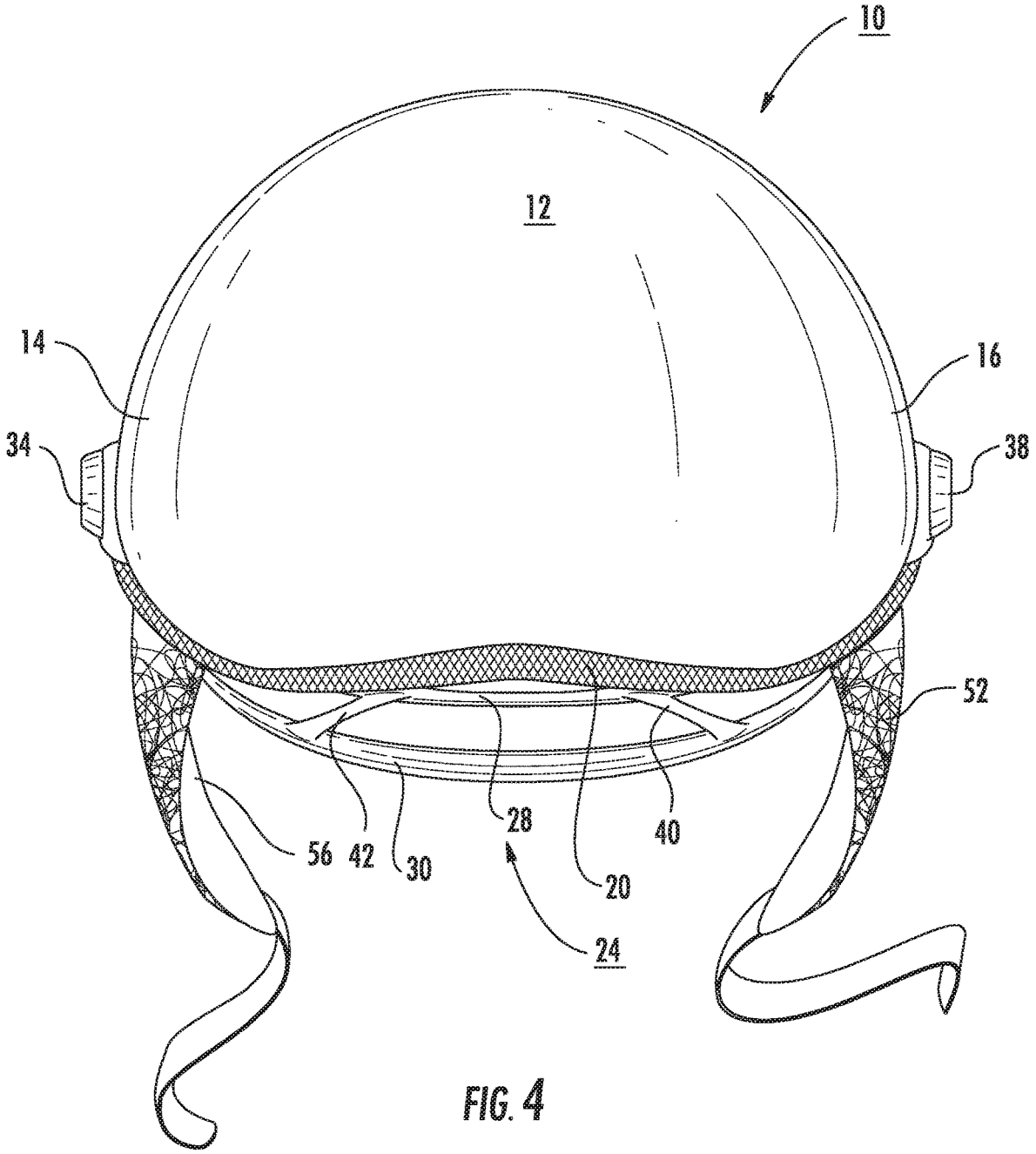
Figure 5:
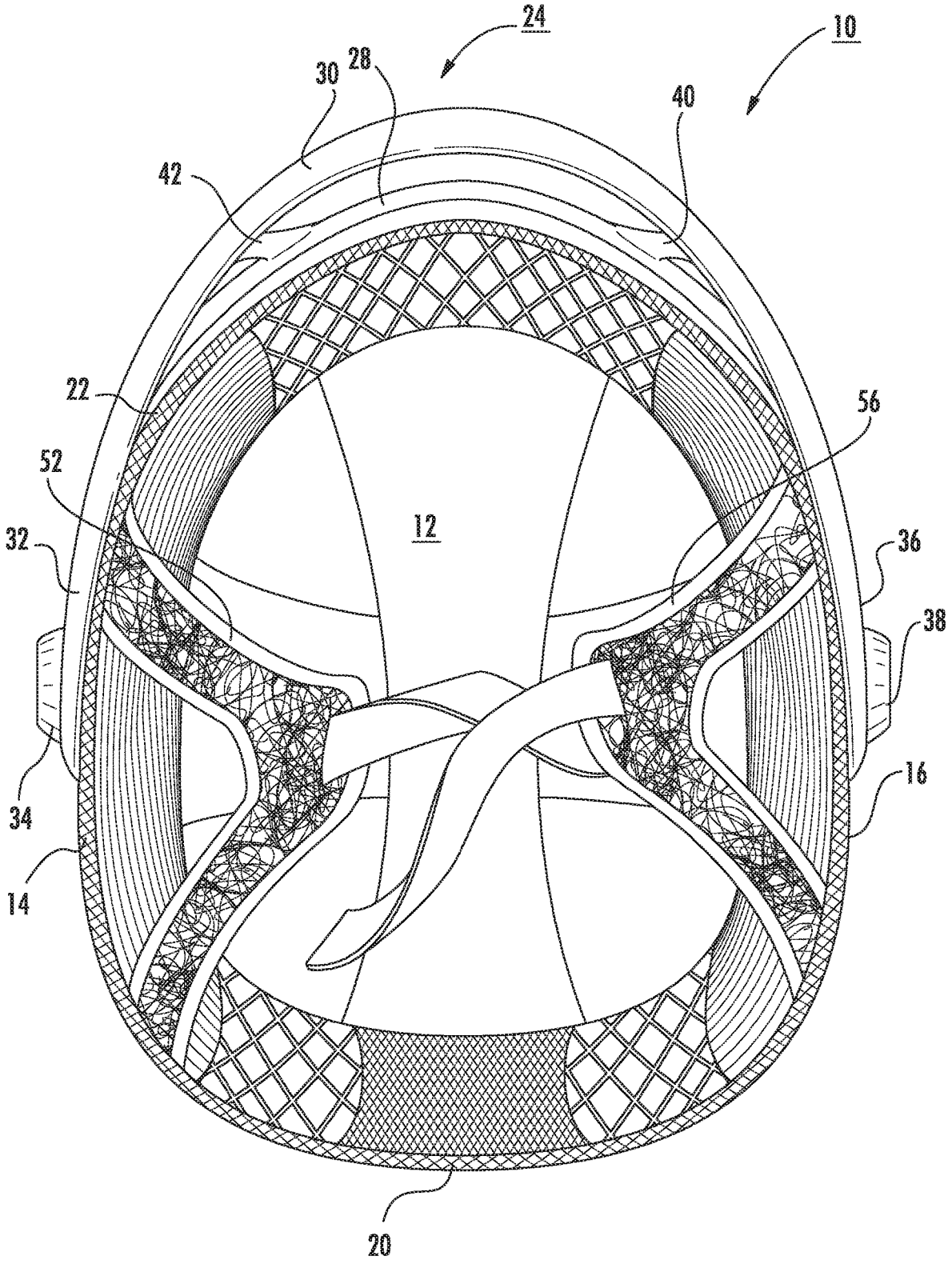

A first pair of lower spaced struts 40, 42 extend between the second and third bars 28, 30 and a second pair of upper spaced struts 44, 48 extend between the first and second bars 26, 28. As shown in FIGS. 1 and 2, the upper struts 44, 48 are positioned so as to leave open the protected space 60 for the visibility of the person wearing the demi-helmet in both the forward direction (arrow 62) and peripheral direction (arrow 64). As noted earlier and shown in FIG. 2, the rearward ends of the three bars 26, 28 and 30 converge at areas 34 and 38 to form a concave shape with the respective first and second struts 44, 48 and with corresponding central open areas 46 and 50. This configuration imparts strength to the helmet-mask combination and insures an unobstructed view in peripheral directions. The lower struts 40, 42 are angled inwardly as shown in FIGS. 1, 2 and 4 in order to provide increased structural support and impact resistance.

As shown in FIGS. 1 and 2, the demi-helmet and mask combination 10 further includes a pair of chin straps 52, 56 attached to strap flaps 54.

It will thus be understood that the protected space 60 is fully protected in a facile manner with the second and third bars 28, 30 extending below the level of the bottom edge 18, with the increased structural integrity defined by the struts 40, 42, 44 and 48 and with the first bar 26 supported across the forward edge 22 of the helmet 12. It will also be understood that the combination 10 provides for entirely unobstructed views through the protected space 60 and beyond in both the forward and peripheral directions, as respectively designated by forward arrow 62 (FIG. 2) and peripheral arrows 64 (FIGS. 1 and 2).

Figure 6:
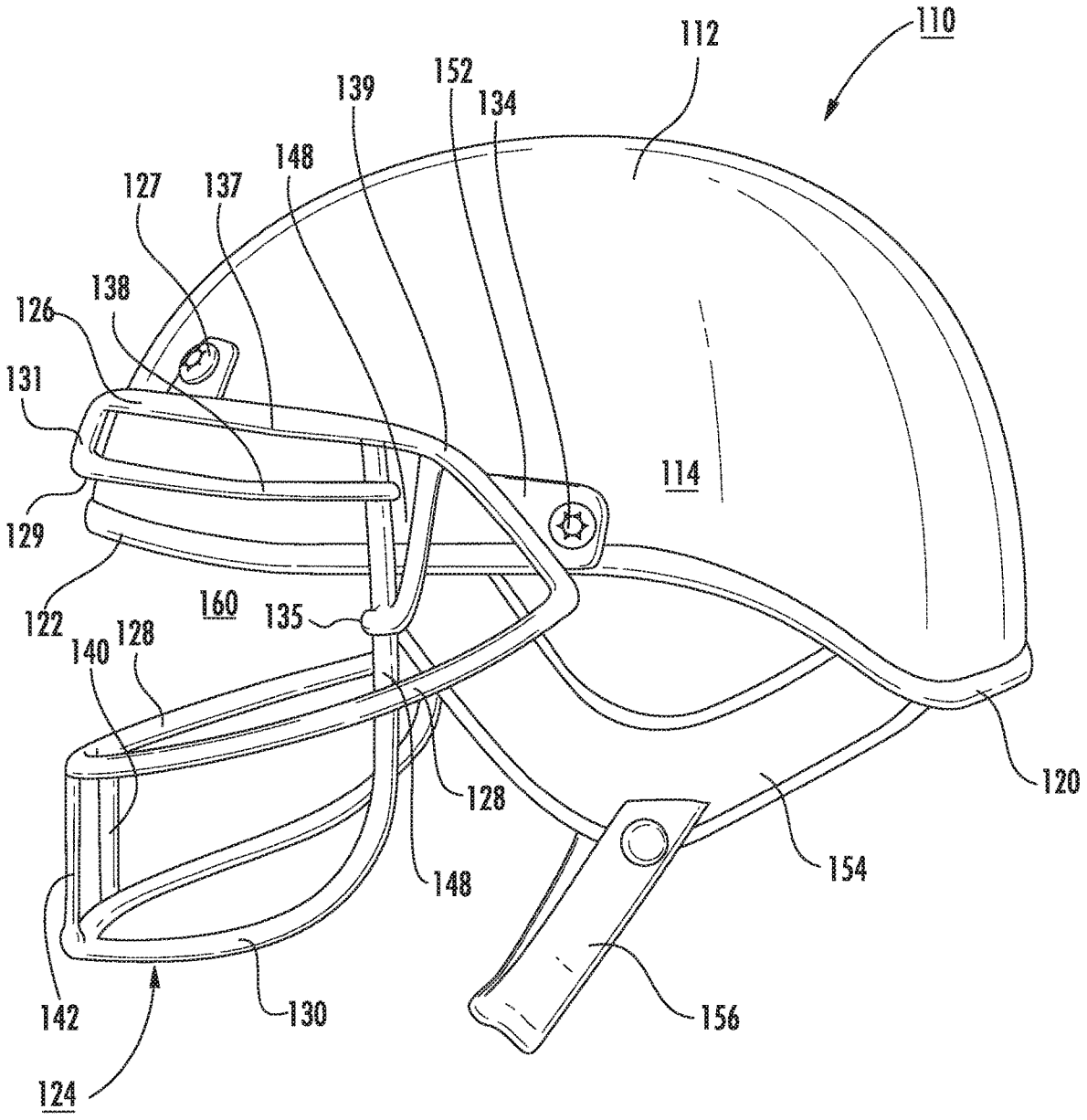
FIG. 6 is a side view of a second embodiment of a demi-helmet and face mask combination according to the present invention.

A second embodiment of the combination helmet and face mask construction is shown in FIG. 6 and referred to generally with the reference numeral 110. In this second embodiment, like features utilize a reference numeral corresponding to like elements in the embodiment of FIGS. 1 through 5, and is preceded by the numeral "1". For example, the top portion of the demi-helmet 110 in FIG. 6 is referred to with the reference numeral 112 and corresponds to demi-helmet portion 12 of FIGS. 1-5; likewise, the face mask construction is referred to by the reference numeral 124 in FIG. 6 and corresponds to the face mask 24 in FIGS. 1-5.

With continued reference to FIG. 6, the construction 110 includes first, second and third impact-resistant bars 126, 128 and 130 with the second and third bars 128, 130 separated by lower struts 140, 142 and the first and second bars 126, 128 separated by upper struts including strut 148. All three of the bars 126, 128 and 130 in FIG. 6 are fixed together at side portion 114 with a fastener 134; it will of course be understood that a like construction exists on the other side of the unit 110. As shown in FIG. 6, in the second embodiment an ancillary bar 129 is provided generally parallel with the first bar 126, with the two bars 126, 129 bridged by strut 148. Preferably, the first bar 126 is rigidly fastened to the top portion 112 above the forward edge 122 with a fastener 127. Also, strut 148 in FIG. 6 is formed by an upwardly extending portion of the third bar 130 that forms a strut bridging and attached at several points including 135, 137 and 139 to the first and auxiliary bars 126 and 129.

Figure 7:
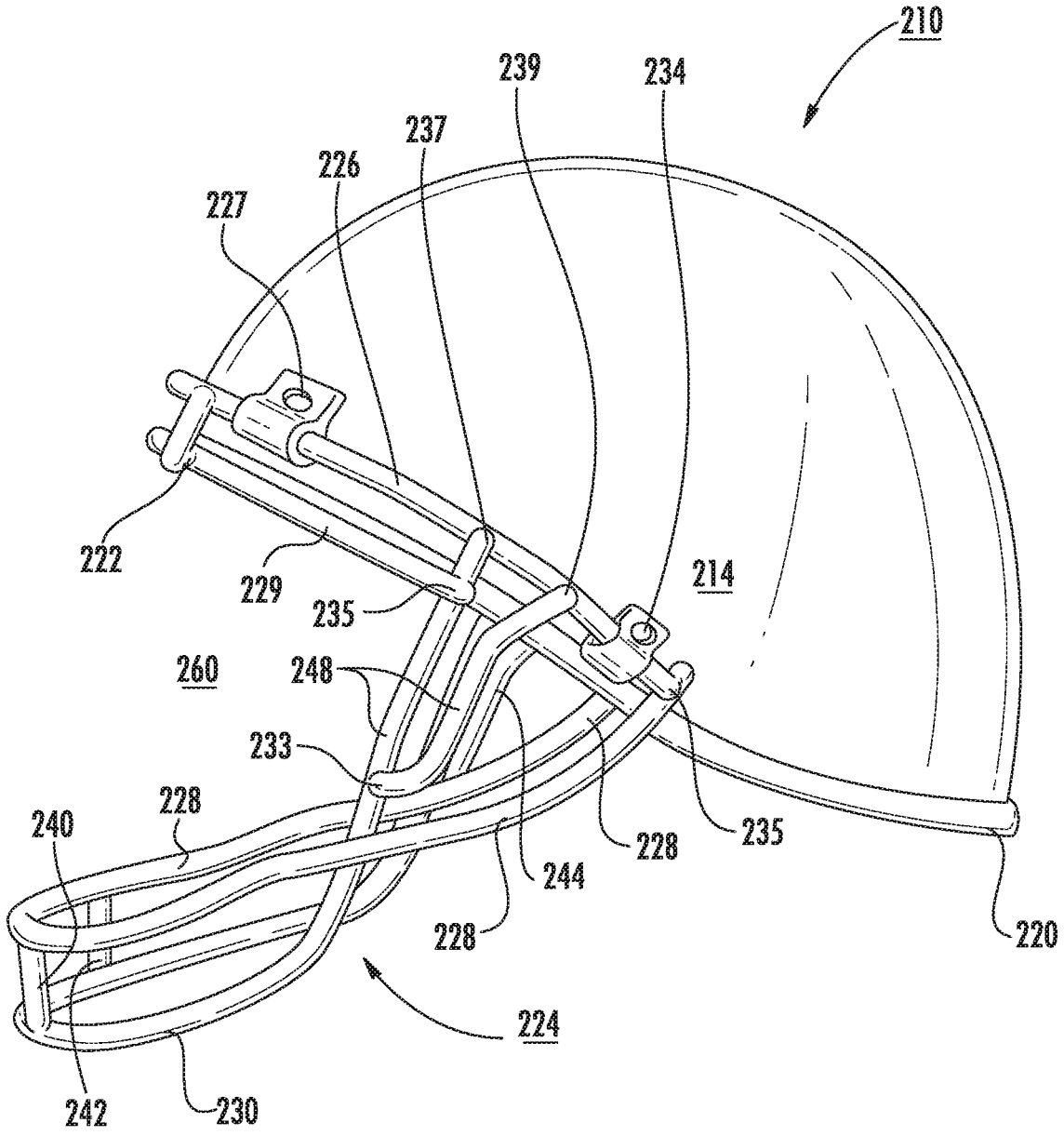
FIG. 7 is a side view of a third embodiment of a demi-helmet and face mask combination in accordance with the present invention.

A third embodiment of the present invention will now be described with reference to FIG. 7, where like reference numerals are preceded by the numeral "2" with respect to FIGS. 1-6, and with the protected space being referred to with the reference numeral 260 and corresponds to protected space 60 in FIGS. 1-5 and the protected space 160 in FIG. 6.

It is understood that this invention is not to be limited to the specific embodiments disclosed, and that modifications and embodiments are intended to be included within the scope of the appended claims. Further, as discussed above, the embodiments of demi-helmet and face mask constructions described herein are useful not only for the protection of motorcyclists, but also in a wide variety of other activities.

What is claimed is:

1. A method of protecting a head of a person while operating a motorcycle, the method consisting of:

placing a spherical hardened shell of a helmet assembly over a top portion of a user's head, the shell including a front edge positioned above eyes of a user, a rear edge, and opposing first and second side edges extending down from the front edge above ears of a user merging with the rear edge, attaching a plurality of protection bars to the helmet assembly at a first and second connection site, one connection site positioned adjacent to each opposing edge, the protection bar assembly including a first protection bar extending distally away from the first and second connection sites, a second protection bar extending, substantially linearly, from the first and second connection sites below the first bar;

positioning the first protection bar between a nose and an upper lip of the user and positioning the second protection bar at a lower lip of the user, the second protection bar being the lowest position of the protection bars from the front edge; and protecting the head and face of the user during a collision or accident with the protection bars not obstructing a view of the user.

2. The method of claim 1, wherein a third protection bar extends from the first connection site along and above the front edge to the second connection site, the protection.

3. The method of claim 2, wherein the first and second protection bars become integral before reaching the connection sites.

4. The method of claim 2, wherein each of the protection bars are manufactured from material having a high impact-resistant core.

5. The method of claim 4, wherein each of the protection bars has a cast metal outer layer.

6. The method of claim 1, wherein the first and third protection bars further include a pair of vertical struts extending between the first and third protection bars and are positioned to not obstruct eyes of the user.

7. The method of claim 6, wherein each of the vertical struts is located adjacent a respective one of the opposing side portions to not obstruct the eyes of the user.

8. The method of claim 2, wherein the first end of the third protection bar is integral to and forms an angle with the integrated portion of the first and second protection bars at the first connection site, and the second end of the third protection bar is integral to and forms an angle with the integrated portion of the first and second protection bars at the second connection site.

9. The method of claim 2, wherein the bars are flattened with a width greater than a thickness.

10. A helmet, consisting of, a spherical hardened shell covering a top portion of a user's head, the shell having a diameter and a height, a front edge located above eyes of a user, a rear edge, and opposing first and second side edges extending down from the front edge to a position above ears of a user and merging with the rear edge;

a protection bar assembly including only three bars, one end attached at a first connection site above the first opposing edge and a second end attached at a second connection site above the second opposing edge, the protection bar assembly further comprising;

a first protection bar extending distally away from the first and second connection sites and positioned between a nose and an upper lip of the user; and a second protection bar extending substantially linearly between the opposing side portions below the first bar and is positioned at a lower lip and chin of the user, the second protection bar being in a lowest position of the only three bars;

wherein with the helmet positioned on the user's head, the second bar extends below the rear edge.

11. The helmet of claim 10, wherein a third protection bar extends from the first connection site along and above the front edge to the second connection site.

12. The helmet of claim 10, wherein the first and second protection bars become integral before reaching the connection sites.

13. The helmet of claim 11, wherein each of the protection bars are manufactured from material having a high impact-resistant core.

14. The helmet of claim 13, wherein each of the protection bars has a cast metal outer layer.

15. The helmet of claim 11, wherein the first and third protection bars further include a pair of vertical struts extending between the first and third protection bars and are positioned peripherally outside of line of sight of the user.

16. The helmet of claim 15, wherein each of the vertical struts is located adjacent a respective one of the opposing side portions to not obstruct the eyes of the user.

17. The helmet of claim 11, wherein the first end of the third protection bar is integral to and forms an angle with the integrated portion of the first and second protection bars at the first connection site, and the second end of the third protection bar is integral to and forms an angle with the integrated portion of the first and second protection bars at the second connection site.

* * * * *